US005503283A

United States Patent [19]

Semersky

[11] Patent Number: 5,503,283

[45] Date of Patent: Apr. 2, 1996

[54] BLOW-MOLDED CONTAINER BASE STRUCTURE

[75] Inventor: Frank E. Semersky, Toledo, Ohio

[73] Assignee: Graham Packaging Corporation, York, Pa.

[21] Appl. No.: 339,082

[22] Filed: Nov. 14, 1994

[51] Int. Cl.[6] ..... B65D 1/142

[52] U.S. Cl. ..... 215/375; 220/608

[58] Field of Search ..... 206/315.5, 315.3, 206/292; 190/109, 110, 111; 215/371, 372, 373, 382, 374, 375; 220/606, 608

[56] References Cited

U.S. PATENT DOCUMENTS 4,108,324 8/1978 Krishnakumar et al. .
4,134,510 1/1979 Chang .
4,174,782 11/1979 Obsomer .
4,249,666 2/1981 Hubert et al. .
4,254,882 3/1981 Yoshino ..... 215/375
4,276,987 7/1981 Michel .
4,598,831 7/1986 Nakamura et al. .
4,785,950 11/1988 Miller et al. ..... 215/375
4,955,491 9/1990 Marshall et al. .
4,981,736 1/1991 Feddersen et al. .
4,993,566 2/1991 Eberle .
4,993,567 2/1991 Eberle, Jr. .
5,005,716 4/1991 Eberle .
5,047,271 9/1991 Feddersen et al. .

*Primary Examiner*—Allan N. Shoap
*Assistant Examiner*—Christopher J. McDonald
*Attorney, Agent, or Firm*—Howson and Howson

[57] ABSTRACT

A base structure for a hot-fill plastic container provides the container with enhanced structural integrity. The base structure uses a series of vertically staggered circumferential ribs interrupted by radial lugs. The disclosed base structure enables the container to withstand the various forces encountered in filling, cooling, and handling.

17 Claims, 4 Drawing Sheets

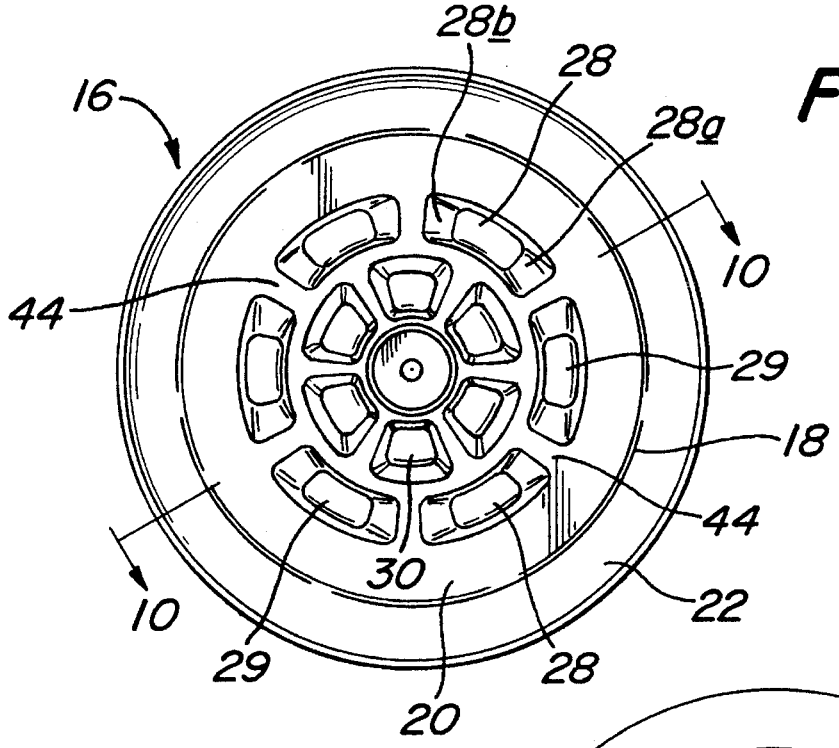
FIG. 8
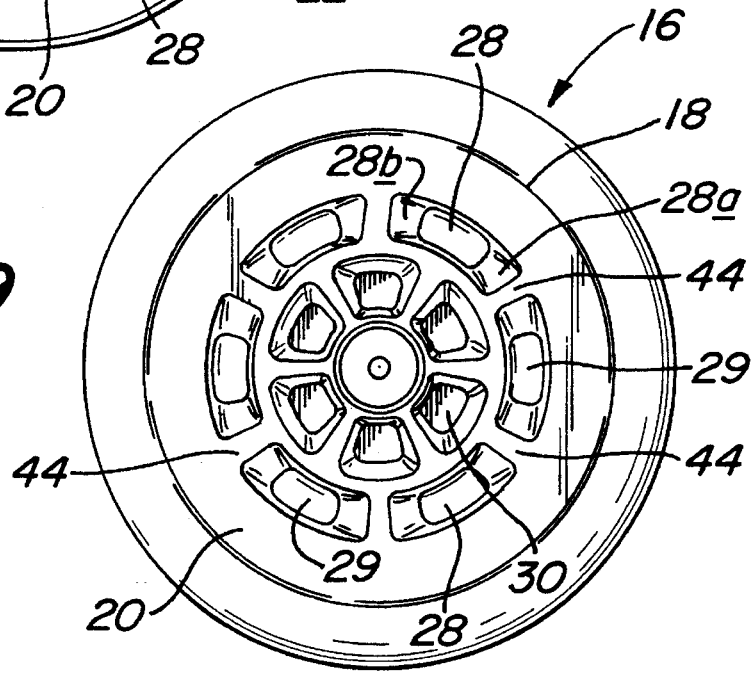
FIG. 9
FIG. 10
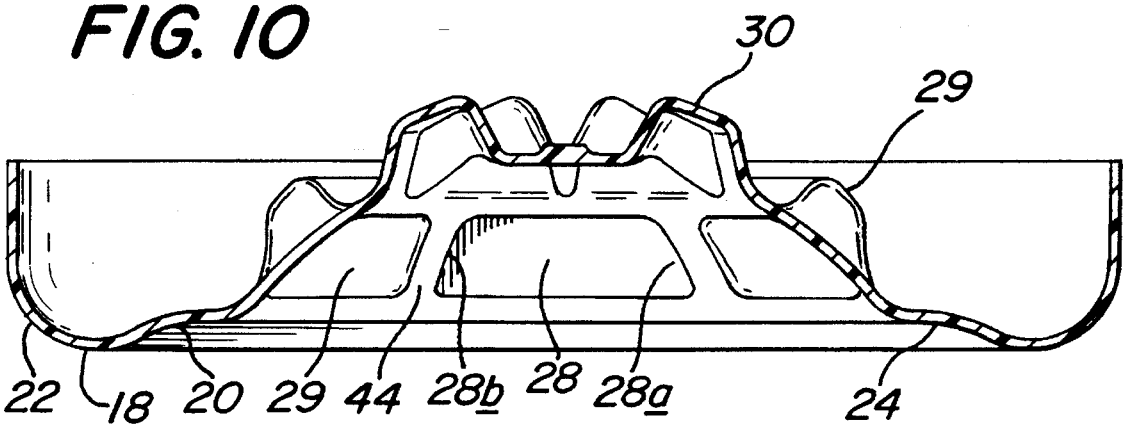

BLOW-MOLDED CONTAINER BASE STRUCTURE

FIELD OF THE INVENTION

The present invention relates to a blow-molded container having a base structure for enhancing the structural integrity of the container, and more particularly, the present invention relates to a base structure having a plurality of tiers of vertically staggered circumferential ribs arranged in a series and interrupted by a series of lugs.

BACKGROUND OF THE INVENTION

Many beverage products are sold to the consuming public in plastic containers such as are shown in U.S. Pat. Nos. 5,005,716 issued to Eberle; 4,108,324 issued to Krishnakumer et al; and 4,134,510 issued to Chang. The design of plastic containers must take into account the container's structural integrity, the manufacturing cost to mass produce the container, and the aesthetic appearance of the container to the eye of the consumer.

A hot-fillable plastic beverage container must be structurally sound to withstand various forces relating to the so-called "hot-fill" process. Moreover, it must withstand rough handling during transportation to the ultimate consumer. A "hot-fill" process is the procedure by which containers are filled with a beverage at a high temperature after which the containers are capped. As the beverage cools within the container, stresses and strains develop in the container due to changes in the volume of the contents. Containers that store products under pressure, such as carbonated beverages, also experience pressure changes due to changes in ambient temperature. A commercially satisfactory container structure must not only withstand these forces from a structural viewpoint, but it must also present an aesthetically pleasing appearance to the ultimate consumer.

The price of many products sold to the consuming public are affected to an extent by the cost of packaging. With plastic beverage containers, the cost of manufacturing a container is affected by the cost of plastic composing the container. Therefore, if the amount of plastic in a container can be reduced, the cost of manufacturing the container can be reduced commensurately. However, in achieving this goal it is known that the thinner the walls and base of the container become, the greater the need to utilize imaginative designs to provide a container that is commercially acceptable.

The desire to decrease the amount of plastics used in a container has resulted in the development of different techniques to design containers that have structural integrity with minimal use of plastic. It is known that shape and location of structural elements such as ribs, hinges, panels, and the like in either the sidewall, or the base, of the container can affect the container's overall structural integrity. While various structural elements molded in the side panel and base structure can afford structural integrity, they must also be visually appealing to the consumer.

The Krishnakumer et al '324 patent illustrates one container base structure design which has various structural elements molded into the base to enhance its structural integrity. In this container, the base has a series of radially extending ribs. The ribs allow the base structure to withstand the various forces applied while minimizing the amount of plastic required.

The Eberle '716 base structure illustrates an alternate design having structural elements designed to enhance the structural integrity of the base. The structure allows the base to withstand the various stresses and strains applied to the container while using only a limited amount of plastic.

The Chang '510 patent utilizes a series of circumferential ribs in combination with radial ribs to provide the desired degree of structural integrity. In Chang, the various ribs are solid, and the radial ribs intersect all of the circumferential ribs.

Although the aforementioned containers and base structures may function satisfactorily for their intended purposes, there is a need for a blow-molded plastic container having a base structure which enhances container structural integrity while requiring a minimum of plastic. The base structure should be capable of accommodating variations in volume of the containers' contents and changes of pressure and temperature. Furthermore, the base structure should be aesthetically pleasing to the eye and should be capable of being manufactured in conventional high speed equipment.

OBJECTS OF THE INVENTION

With the foregoing in mind, a primary object of the present invention is to provide a novel container base structure which improves the overall structural integrity of the container.

Another object of the present invention is to provide a structurally sound container base structure which uses a minimum of plastic material, yet provides superior structural integrity.

A further object of the present invention is to provide a container base structure which is aesthetically pleasing to the eyes of the consumer even after it has been subject to various stresses and strains associated with filling, transportation and handling.

A still further object of the present invention is to provide a container having an improved base structure which affords manufacture by high speed automated equipment at a minimum of cost.

SUMMARY OF THE INVENTION

More specifically, the present invention provides a base structure for a blow-molded container having a side wall and base. The base structure has a support heel which has an inner and an outer portion. The outer portion of the support heel merges with the container side wall. The inner portion of the support heel merges with a central concave wall, the central concave wall being surrounded by the annular support heel.

The central concave wall has a plurality of series of circumferential ribs formed in vertical tiers. The circumferential ribs in each series are individually interrupted by a series of lugs. A lug is located at each end of each rib. The circumferential ribs and lugs cooperate to enhance the structural integrity of the container base.

BRIEF DESCRIPTION OF THE DRAWINGS

The foregoing and other objects, features and advantages of the present invention should become apparent in the following description taken in conjunction with the accompanying drawings, in which:

FIG. 8 is a top plan view of an alternate embodiment of a base structure;

FIG. 9 is a bottom plan view of the base structure of FIG. 7; and

FIG. 10 is a cross-sectional elevational view of FIG. 8 taken along line 10—10.

DETAILED DESCRIPTION OF PREFERRED EMBODIMENTS

Figure 1:
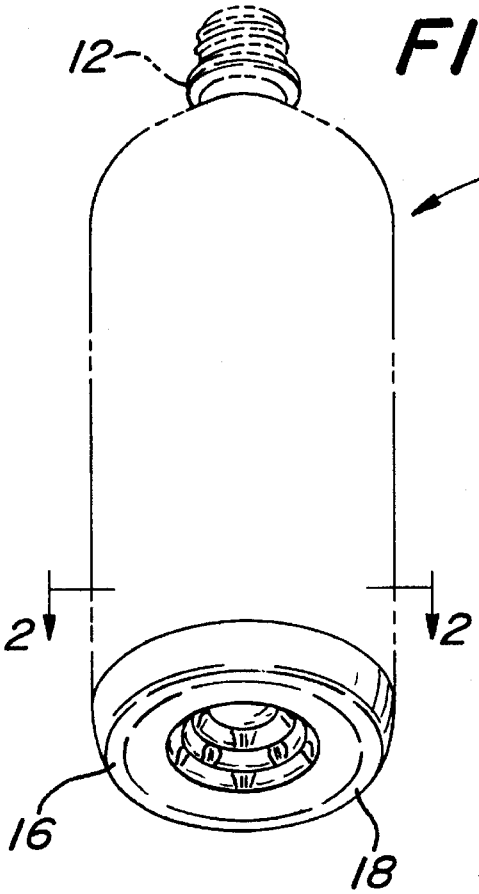
FIG. 1 is perspective view of a container having a base structure embodying the present invention.

Referring now to the drawings, FIG. 1 illustrates a blow-molded plastic container 10 such as may be used in the sale of juices and non-carbonated beverages. Such containers can typically be designed to contain liquid volumes of a gallon, 64 ounces, or the like. The container 10 has a neck 12 defining an opening allowing for filling and pouring of a beverage. The neck 12 merges with a sidewall 14. The sidewall 14 merges with the base structure 16 opposite the neck. The container 10 is designed to receive a cap (not shown) to seal the container and confine the beverage inside the container. While the sidewall as shown is cylindrical, any shape can be utilized, such as a rectangular cross-sectional sidewall. In such an embodiment, the base would be shaped appropriately to merge with the sidewall.

When used in hot-fill processing, the container is filled with a beverage at an elevated temperature. The cap is then installed on the container neck. As the temperature of the beverage and air decreases to ambient temperatures, its volume decreases. The container and its base structure must react to the reduction in volume and accommodate the stresses and strains while remaining structurally sound. Moreover, the base must also be capable of withstanding various other forces, such as changes in internal pressure with carbonated beverages, and the usual handling forces.

Figure 2:
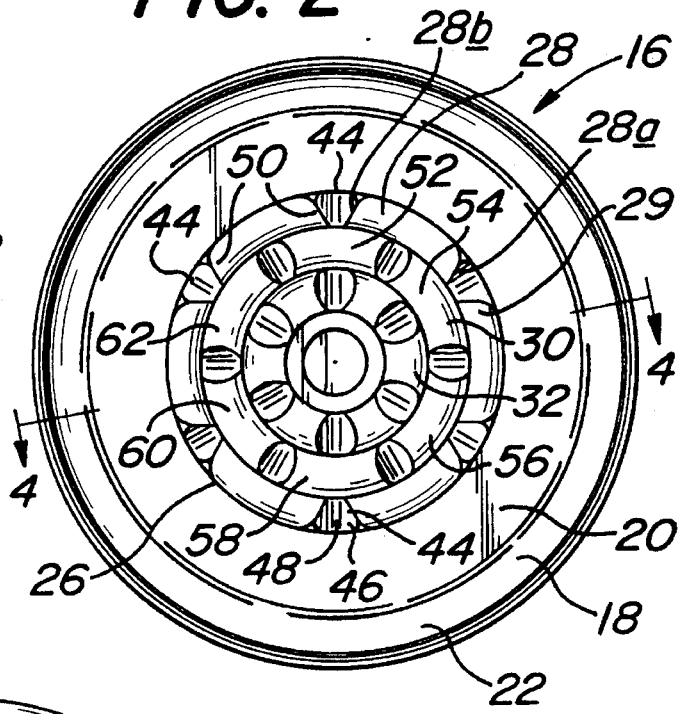
FIG. 2 is a top plan view of a base structure having three vertical tiers.
Figure 3:
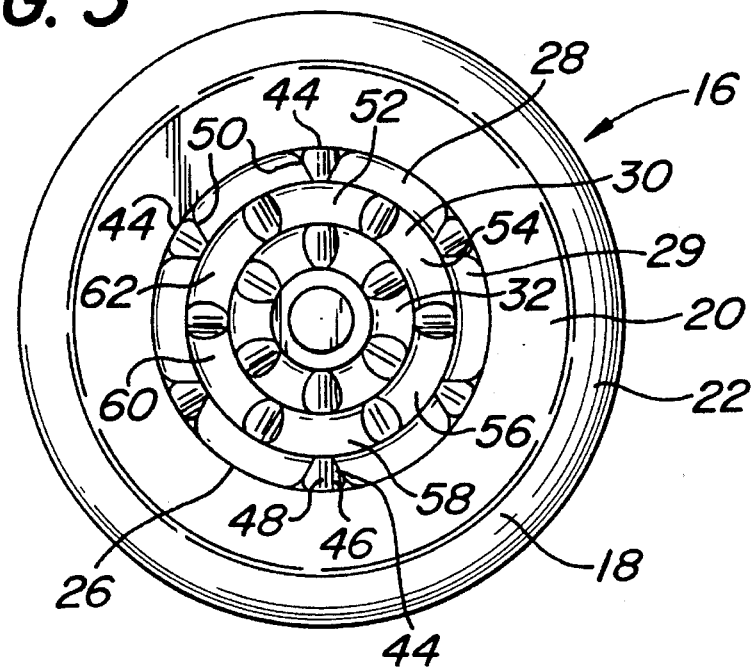
FIG. 3 is a bottom plan view of the base structure of FIG. 2.

The base structure of the present invention is shaped to withstand these various forces. The base structure reduces the need for plastic, yet still enhances the overall structural integrity of the container. To this end, as seen in FIG. 2, the base structure has an annular support heel 18. The support heel 18 allows the container 10 to be supported erect on a horizontal surface. The support heel is rounded and forms an annular line of contact with a horizontal surface (not shown).

The annular support heel 18 has an inner and an outer portion, 20 and 22, respectively. The outer portion 22 merges with the container's sidewall 14. The inner portion 20 of the annular support heel 18 has an upwardly inclined surface 24 which merges with a central concave wall 26.

Figure 4:
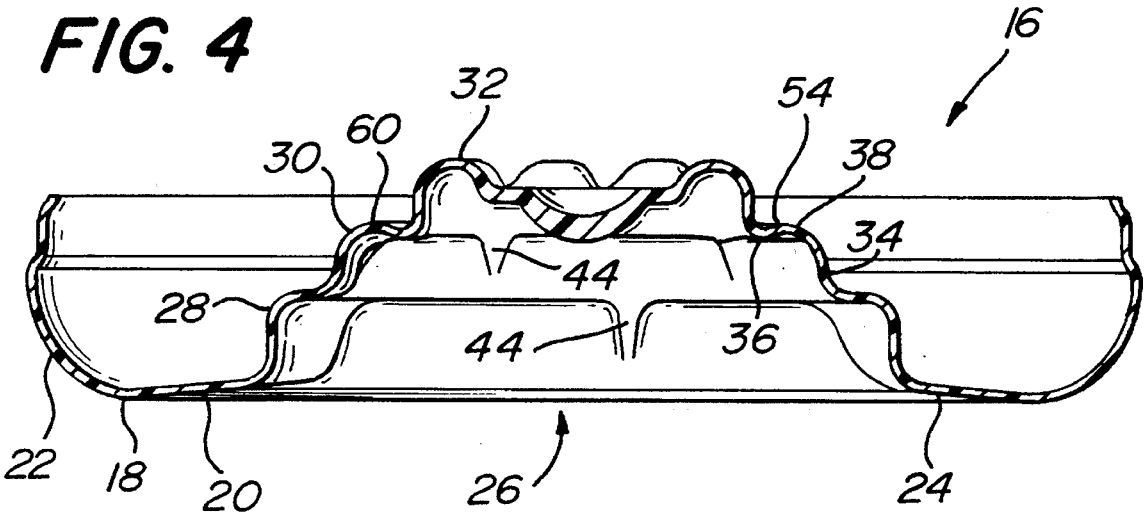
FIG. 4 is a cross-sectional elevational view of FIG. 2 taken along line 4—4.
Figure 5:
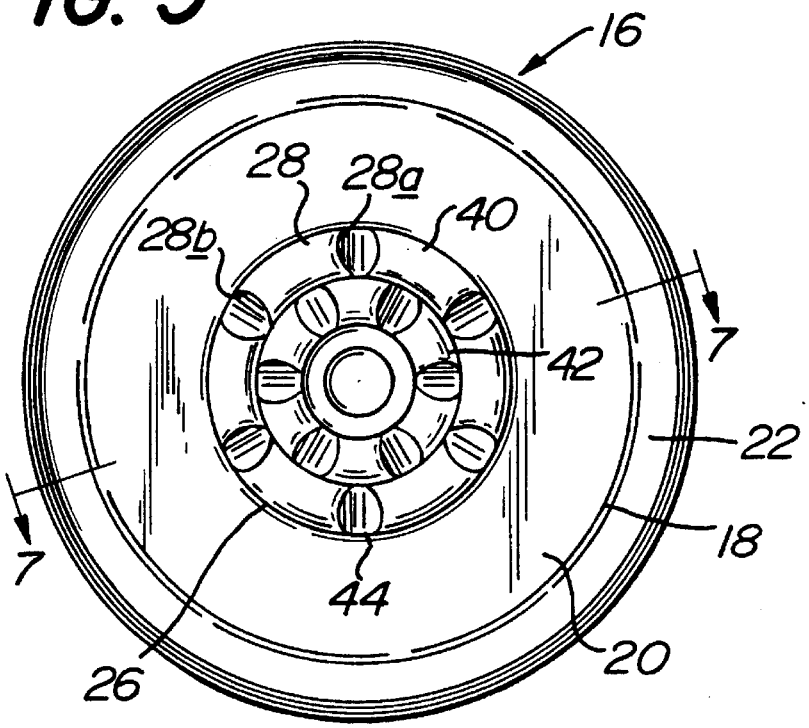
FIG. 5 is a top plan view of a base structure having two vertical tiers.

The central concave wall 26 is provided with integral molded structural elements that provide the base 16 with sufficient structural integrity to withstand the various forces acting on the container 10. To this end, the central concave wall 26 has a plurality of vertically-staggered series of circumferential ribs, 28, 30 and 32. Each series of ribs is concentric with the center of the concave wall, but each series is located at a different radial distance and at a different level to provide tiers of ribs. Thus, the series of circumferential ribs 28, 30 and 32 define a staggered appearance in a vertical cross-section through the central concave wall. See FIG. 4. Each series of ribs 28, 30 and 32 are composed of circumferential individual ribs. As best seen in FIGS. 2, 5 and 8, each rib, such as the rib 28 in FIG. 2, has an arcuate rectangular configuration with radial end portions **28*a* and 28*b*. End portions of endwise adjacent ribs, such as ribs 28 and 29 in FIG. 2, are defined by a lug 44. The lug 44 has an apex 48 defining a narrow valley having a V-shaped configuration between the ends of the ribs 28 and 29. For instance, series 30 is composed of individual ribs 52, 54, 56, 58, 60 and 62**.

Each circumferential rib comprises an outermost substantially vertically projecting portion 34 and a shorter downwardly depending portion 36, connected by arcuate sections 38. The outermost vertically projecting portion 34 either merges with a circumferential rib in a lower tier, or with the inner portion 20 of the annular support heel 18. The downwardly depending portion 36 either merges with the center of the central concave wall 26 or with the outermost vertically projecting portion of an adjacent circumferential rib. The semi-arcuate, or slightly flattened, section 38 provides the connection between the outermost vertically projecting portion 34 and the shorter downwardly depending portion 36 and defines the cross-section of the circumferential rib at about its median.

Figure 7:
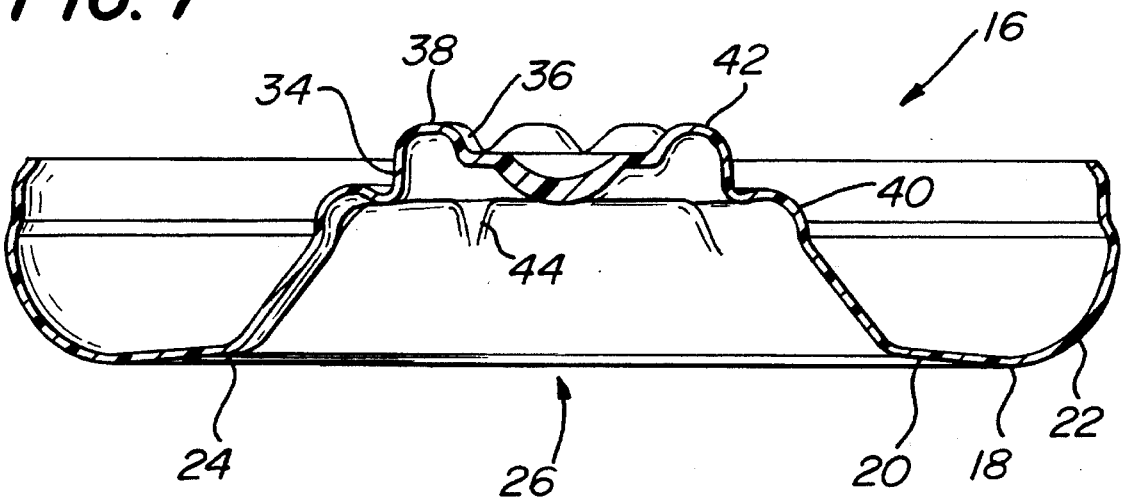
FIG. 7 is a cross-sectional elevational view of the base structure of FIG. 5 taken along line 7—7.
Figure 6:
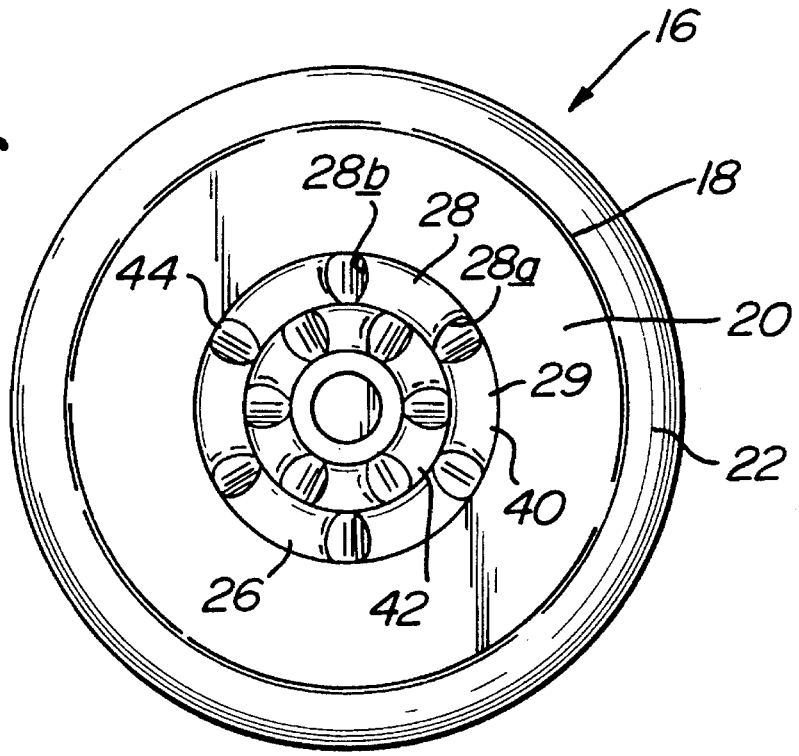
FIG. 6 is a bottom plan view of the base structure of FIG. 5.

As shown in FIGS. 1–4, the central concave wall 26 is illustrated with three staggered series of circumferential ribs. However, greater or fewer, series of ribs can be used. For instance, FIGS. 5–7 show the use of two staggered series of circumferential ribs 40 and 42.

To enhance the structural integrity provided by the circumferential ribs, each series is interrupted by a plurality of lugs 44. As shown in all the figures, six lugs 44 placed at equal radial distances from each other interrupt each series of ribs. However, fewer lugs can be utilized, for instance three lugs on each tier. Each of the lugs 44 as shown in FIGS. 2–7 is pyramidal in shape having a base 46 and an apex 48. The base 46 is disposed upwardly into the container 10 and the apex 48 is disposed downwardly. However, other lug shapes are possible, such as rectangular or trapezoidal as shown in FIGS. 8, 9 and 10. Each lug 44 defines the end 50 of each individual rib in the series of ribs. As shown in the figures, lugs which are located on adjacent staggered series of circumferential ribs are offset angularly at equal angular distances relative to each other.

It is the combination of the vertical tiered series of circumferential ribs and the construction and placement of the interrupting radial lugs at angularly-offset locations which allow the base structure of the present invention to provide the desired structural integrity of the container bottom. The ribs and the lugs located on the central concave wall act in a manner to withstand the changes in temperature, pressure, and volume within the container during the hot-fill processing. The ribs and lugs cooperate to resist everting of the bottom wall by providing multiple paths of interengageable surfaces that make it difficult for deflection, once initiated, to propagate to undesirable distortion of the bottom wall.

Containers having this base structure design can be produced in commercial quantities with high speed equipment.

While preferred embodiments of the present invention have been described in detail, various modifications, alterations, and changes may be made without departing from the sphere and scope of the invention as defined in the appended claims.

I claim:

1. A base structure for a blow-molded container having a sidewall, comprising:

a support heel having an outer portion and an inner portion, said outer portion merging with the container sidewall;

a central concave wall surrounded by said support heel and merging with said inner portion of said support heel;

a plurality of series of circumferential ribs formed in vertical tiers in said central concave wall, each rib having an arcuate rectangular configuration with radial end portions; and lugs radially interrupting said circumferential ribs in each series and defining their end portions, each lug having a narrow portion between radial end portions of endwise adjacent ribs for defining therebetween a narrow valley having a substantially V-shaped configuration, the lugs in adjacent series of said circumferential ribs being offset angularly with respect to one another;

whereby the ribs and lugs of the base structure cooperate to enhance the structural integrity of the container by rigidifying said central concave wall and by providing multiple paths of interengageable surfaces that make it difficult for deflection, once initiated, to propagate to undesired distortion.

2. A base structure according to claim 1, wherein each of said series of circumferential ribs has an equal amount of said lugs.

3. A base structure according to claim 2, wherein each of said series of circumferential ribs is interrupted by six lugs.

4. A base structure according to claim 2, wherein each of said series of circumferential ribs is interrupted by three lugs.

5. A base structure according to claim 1, wherein each of said lugs is pyramidal in shape having a base and an apex.

6. A base structure according to claim 5, wherein each lug extends between two of said circumferential ribs on the same series with its base up and its apex down.

7. A base structure according to claim 1, wherein each of said lugs is trapezoidal in shape.

8. A base structure according to claim 1, wherein each of said series of circumferential ribs comprises an outermost vertically projecting portion and a shorter downwardly depending portion connected by a semi-arcuate flat section.

9. A base structure according to claim 8, wherein said central concave wall has three vertical tiers of said series of circumferential ribs.

10. A base structure according to claim 8, wherein said central concave wall has two vertical tiers of said series of circumferential ribs.

11. A base structure according to claim 1, wherein said support heel is rounded providing a circumferential line of support.

12. A base structure according to claim 11, wherein said inner portion of said support heel has an upwardly inclined surface which merges with said central concave wall.

13. A base structure for a blow-molded container having a sidewall, comprising:

an annular support heel having an outer portion and an inner portion, said outer portion merging with the container sidewall;

a bottom wall defining a central concavity surrounded by said annular support heel and merging with said inner portion of said annular support heel;

at least two tiers of circumferential ribs formed in staggered relation in said central concave wall to define a corresponding number of tiers; and each of said series of circumferential ribs having a plurality of lugs defining opposite ends of each rib, each lug having a base disposed upwardly and an apex disposed downwardly;

whereby the ribs and lugs cooperate to enhance the structural integrity of the container.

14. A base structure according to claim 13, wherein each of said series of circumferential ribs in adjacent tiers is interrupted by lugs which are offset angularly relative to one another.

15. A base structure according to claim 14, wherein each of said circumferential ribs comprises an outermost vertically projecting portion connected to a short downwardly depending portion via a semi arcuate section.

16. A base structure according to claim 15, wherein each said lug has a trapezoidal shape.

17. A base structure according to claim 15, wherein each said lug has a pyramidal shape.

* * * * *